US005095336A

United States Patent [19]

Corona et al.

[11] Patent Number: 5,095,336

[45] Date of Patent: Mar. 10, 1992

[54] TEMPERATURE CONTROL OF A FLUORESCENT LAMP HAVING A CENTRAL AND TWO END AMALGAM PATCHES

[75] Inventors: Stephen C. Corona, Rochester; Thomas J. Hammond, Penfield; Dominick J. Maiorano, Webster, all of N.Y.

[73] Assignee: Xerox Corporation, Stamford, Conn.

[21] Appl. No.: 610,872

[22] Filed: Nov. 8, 1990

[51] Int. Cl.[5] ..... G03G 15/04

[52] U.S. Cl. ..... 355/229; 313/15; 313/490; 355/69

[58] Field of Search ..... 355/228, 229, 67, 69; 313/13, 15, 490; 315/108

[56] References Cited

U.S. PATENT DOCUMENTS

| | | | |
|---|---|---|---|
| 3,629,641 | 12/1971 | Hofmann | 313/490 |
| 3,860,852 | 1/1975 | Latassa et al. | 313/490 |
| 4,437,041 | 3/1984 | Roberts | 315/248 |
| 4,499,400 | 2/1985 | Anderson et al. | 313/265 |
| 4,581,557 | 4/1986 | Johnson | 313/25 |
| 4,827,313 | 5/1989 | Corona | 355/30 |
| 4,870,454 | 9/1989 | Kurusu et al. | 355/69 |

FOREIGN PATENT DOCUMENTS

| | | | |
|---|---|---|---|
| 0063064 | 3/1988 | Japan | 355/228 |

*Primary Examiner*—A. T. Grimley
*Assistant Examiner*—William J. Royer

[57] ABSTRACT

An amalgam fluorescent lamp is designed to operate with minimum axial illumination variations when changing from an off to an on state. This is accomplished by incorporating at least three amalgam patches internal to the lamp. Two patches are located at opposite ends of the lamp, and at least a third patch is centrally located. Each patch has an associated thermistor ands external heater sleeve. The patch temperature which correlates wiht the optimum lamp operating temperature is continuously monitored and adjustments are made to the heater sleeve elements to maintain the patches at desired optimum temperature.

8 Claims, 3 Drawing Sheets

TEMPERATURE CONTROL OF A FLUORESCENT LAMP HAVING A CENTRAL AND TWO END AMALGAM PATCHES

BACKGROUND AND MATERIAL INFORMATION DISCLOSURE

This invention relates to an illumination system and, more particularly, to an extra high output (EHO) mercury fluorescent lamp system utilizing multiple internal amalgam patches and external temperature control mechanisms to control the amalgam "cold spot temperature" and hence the internal mercury pressure within the low pressure (fluorescent) lamp envelope. The combination of the lamp structure and external control mechanism stabilizes the illumination output during both continuous and transient operation significantly reducing problems associated with mercury migration and depletion problems during startup.

Low pressure, mercury vapor fluorescent lamps are used in a variety of lighting applications. Of particular interest, for purposes of the present invention, is the widespread use of fluorescent lamps to illuminate documents being copied in a reprographic device.

In a conventional mercury fluorescent lamp, an electrical discharge, arc current, is generated through a mixture of low pressure mercury vapor and a fill gas typically argon, neon, krypton, xenon or mixtures thereof. The visible illumination output from the lamp depends, among other variables, on the mercury vapor pressure within the lamp tube. The mercury vapor pressure is generally controlled by maintaining a cooled area "cold spot" somewhere on the wall of the lamp envelope. It is known in the prior art that the optimum mercury pressure for maximum visible light output of a fluorescent lamp is approximately 7 mtorr (independent of current). This corresponds to a mercury cold spot temperature of approximately 35° C. At this pressure and temperature, the light output from the lamp increases monotonically with the arc current. At cold spot temperatures higher or lower than the optimum, light output falls off. It is therefore desirable to maintain the cold spot temperature, and therefore the mercury pressure, at optimum at any lamp current and ambient operating temperature. Prior art techniques for accomplishing this function typically require a temperature-sensitive device such as a thermocouple, thermistor or thermostat to monitor the temperature of the cold spot. A feedback circuit providing closed loop control of a temperature-regulating device is used to maintain the optimum temperature.

While this technique has been shown to be successful at low to moderate lamp power loadings, higher lamp temperature generated at elevated power loadings cause severe illumination stability problems. For certain document reproduction applications, it is desirable to operate the fluorescent illumination source at extremely high power loadings. In the prior art techniques mentioned above, the power loadings for a high output (HO) T8 fluorescent lamp is usually less than 3.25 watts/linear inch, whereas in high power T8 EHO applications, power density can be up to 10 watts/linear inch of lamp lighted length. At this increased loading, the lamp wall temperature is greatly increased, requiring the use of active cooling devices such as fans, solid state (Peltier) coolers and the like. Additionally, the lamp is very sensitive to its axial thermal temperature profile. Changes in the axial temperature profile due to transient operation or environment can cause wide variation in light output along the length of the lamp, drastically affecting the lamp illumination stability.

In order to achieve better thermal control of a fluorescent lamp at high power loadings, it is known to incorporate an amalgam-forming material such as an indium patch, within the lamp envelope. The indium forms an amalgam with the mercury, thus chemically containing the mercury within the amalgam. The temperature at which mercury is released from the amalgam is significantly higher than the optimum lamp wall temperature of the conventional non-amalgam lamp (100° C. versus 35° C.). (The optimum temperature is somewhat adjustable by the amalgam material composition.) Thus, use of the amalgam fluorescent lamp significantly reduces the cooling requirements by providing an optimum cold spot temperature much closer to the lamp wall temperature at the high power loadings.

Representative of prior art publications using amalgams in the interior of fluorescent lamp envelope are:

U.S. Pat. Nos. 4,499,400 and 4,437,041 disclose incorporating a lead-tin-bismuth alloy within a solenoid electric field lamp to control the mercury vapor pressure. The amalgam is wetted onto an internal helical coil assembly (in the '400 patent) or as a patch on a conductive strip within the lamp. In U.S. Pat. No. 4,581,557, two patches are formed within an arc discharge tube which is contained within a high-density auto light transmissive envelope. The amalgam is used to control fluctuation in power supplied to the lamp. U.S. Pat. No. 3,860,852 uses a plurality of amalgams formed on metal strips attached to each of the electrode stems for the purpose of stabilizing temperature response. U.S. Pat. No. 4,827,313 discloses an amalgam fluorescent lamp with a single patch formed on the entire surface of the lamp and feed-back control circuitry to control amalgam temperature by varying power to an associated resistor heater sleeve.

One problem not addressed by the prior art is illumination instability caused by mercury migration within the lamp envelope during both operating and non-operating conditions. With a non-amalgam lamp, mercury is collected at the cold spot during operation. During off periods, when no power is applied to the lamp, the mercury gradually and eventually redeposits itself over the entire lamp (assuming an isothermal condition within the lamp). This uncontrolled deposition is sometimes called mercury migration and can cause severe and sometimes long term axial illumination degradation until all the mercury within the lamp is again controlled primarily by the cold spot. In an amalgam type lamp, the amalgam is such an effective collector that the mercury tends to remain collected in the amalgam even during extended off periods. While this prevents an "excess mercury condition" it can lead to "mercury starvation" conditions at the lamp ends causing reduced illumination output in these regions until the mercury is again redistributed by thermal, convective and electrical forces within the lamp.

According to a first aspect of the present invention, a multiple amalgam patch lamp is designed to provide several mercury storage sites along the linear lamp axis, each site contributing to the sustaining of proper mercury pressure in it's localized region. Also included is a control system to monitor and adjust the temperature of said amalgam sites. Because of the distributed nature of these mercury sources, mercury is rapidly available along the entire lamp length even after long power-off periods. According to another aspect of the invention, the physical positioning and geometry of the patches is designed to achieve an optimum axial illumination output of the lamp by individually controlling the temperature of the individual amalgam sites. More precisely, the invention relates to a monitoring and control system, for an amalgam fluorescent lamp, said lamp having a first and second amalgam patch formed on the interior surface of the lamp envelope and at opposite ends, and at least a third amalgam patch formed at a generally central location on the interior surface of said lamp envelope, and means for providing independent monitoring and controlling of the temperature at each of said amalgam patches so as to provide overall control of the operating temperature of the lamp.

DESCRIPTION OF THE INVENTION

Figure 1:
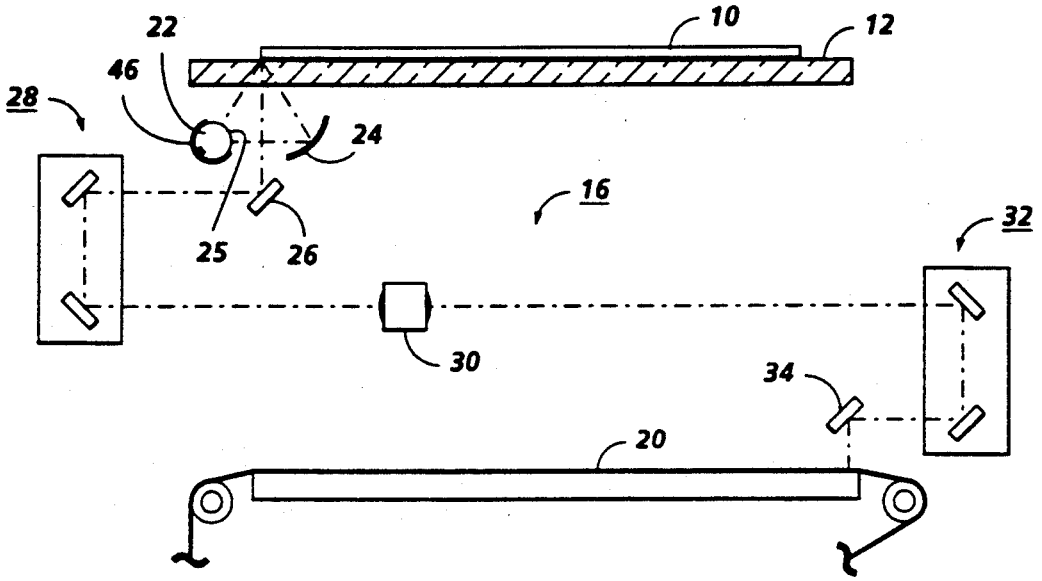
FIG. 1 shows, in side view, a document scanning system incorporating an amalgam lamp whose output and temperature is controlled according to the principles of the present invention.

Referring now to FIG. 1, there is shown an optical scanning system for a document reproduction machine which incorporates an amalgam fluorescent lamp 22 with the associated control circuitry of the present invention. As shown, an original document 10 is positioned face-down on a transparent platen 12. Optical assembly 16 contains the optical components which incrementally scan-illuminate the document from left to right and project a reflected image onto a photosensitive medium 20. Medium 20, in this embodiment, is a belt-type photoreceptor, but may also be a drum-type photoreceptor or a linear multi-element photosensor such as a CCD array. Optical assembly 16 comprises an elongated amalgam fluorescent lamp 22 and associated reflector 24. Lamp 22 and reflector 24, along with scan mirror 26 are adapted to travel, as a unit, along a path parallel to, and beneath the platen. Lamp 22, in conjunction with reflector 24, illuminates an incremental line portion of document 10 through clear aperture 25.

The reflected image is reflected by scan mirror 26, to a corner mirror assembly 28, adapted to move at ½ the rate of mirror 26. The document image is projected along the optical path and is projected by lens 30 onto the surface of medium 20 via a second corner mirror assembly 32 and a belt mirror 34 to form an electrostatic latent image corresponding to the information areas contained on document 10. The latent image can then be developed and transferred to an output medium and fixed, using known xerographic principles. It is understood that if the photosensitive medium is a photosensor array, related signals corresponding to the scanned image are stored and processed for subsequent printout.

According to a first aspect of the present invention the operating temperature of lamp 22 is controlled by forming a plurality of amalgam patches on the interior walls of the lamp and providing for independent monitoring and temperature control of these patches to maintain the patches at some optimum temperature at which temperature variation during mercury migration is reduced. This is accomplished, in the embodiment shown in FIGS. 2 and 3, by forming three amalgam patches, 40, 42, and 44, one near each end of the lamp and one generally centrally located. The end patches 40, 44 are located a sufficient distance from the lamp and filaments so that they are not influenced by the hotter temperatures generated by the filaments. A lamp heater sleeve assembly 46 is fitted on the outside surface of the lamp envelope covering all areas of the lamp save the aperture 25. The heater sleeve assembly includes four separate sleeve heater segments, 46A, 46B, 46C, and 46D. Segment 46A, 46B, and 46C are located adjacent the amalgam patches 40, 42, 44 respectively. Segment 46D comprises the sleeve heater segment which covers the remainder of the lamp envelope. As will be seen, each sleeve heater segment is separately controlled to selectively apply heat to the associated amalgam patch or lamp surface. Each amalgam patch 40, 42, 44 has an associated thermistor 40T, 42T, 44T for monitoring the patch temperature. A fourth thermistor 46T monitors the temperature of heater sleeve segment 46D.

Figure 2:
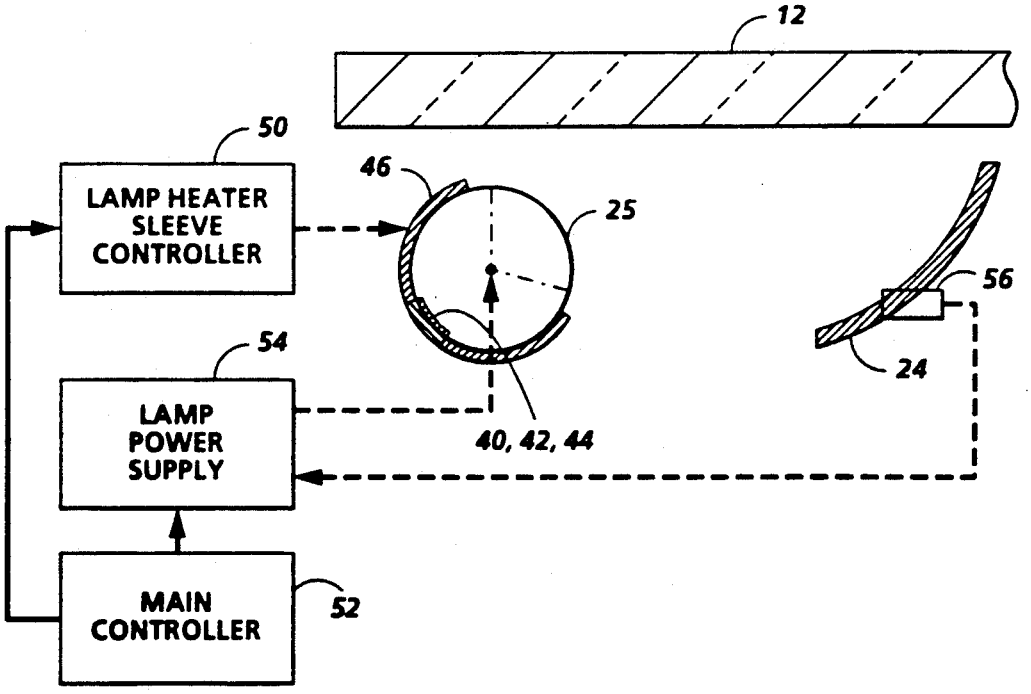
FIG. 2 is an end view of the FIG. 1 system showing the amalgam lamp, platen, opposing reflector with photosensor, and a block diagram of a control mechanism.
Figure 3:
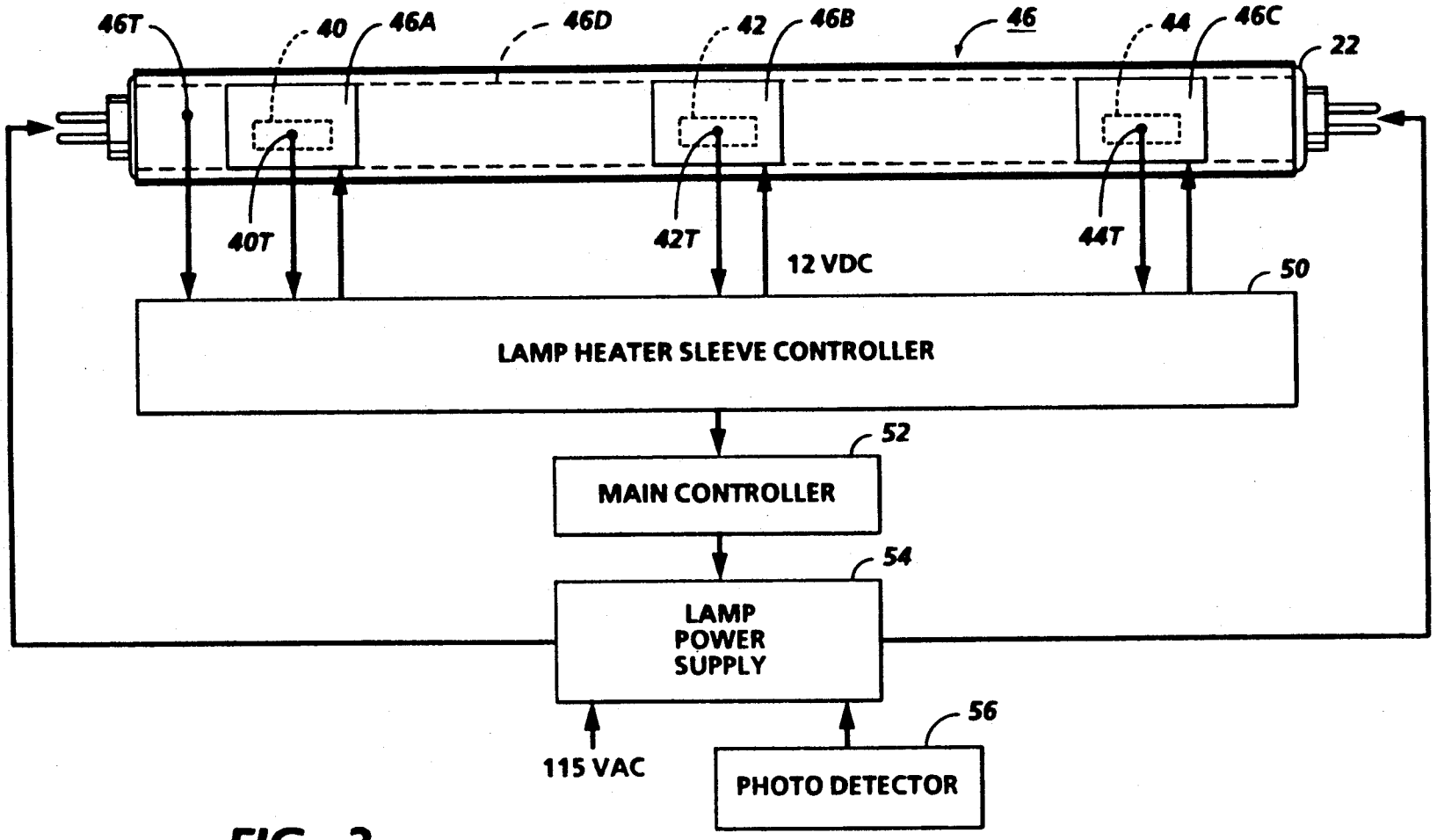
FIG. 3 is a front view of the amalgam lamp of FIGS. 1 and 2 showing the location of three amalgam patches and the associated heater sleeve containing individual heating elements and thermistors.

The lamp is electrically connected into the temperature control circuit shown in FIGS. 2 and 3. A heater sleeve controller circuit 50 is connected between main machine controller 52 and the lamp. Circuit 50 receives analog electrical signals from thermistor 40T, 42T, 44T, and 46T and sends heating signals to the sleeve segments 46A, 46B, 46C, 46D respectively. High frequency lamp power supply 54 provides power to lamp 22. The power is adjustable in response to signals from photodetector 56 positioned to view the output of lamp 22. The operation of power supply 54 is further regulated by controller 52. The operation of the control system will be discussed in further detail below.

Turning now to a more detailed consideration of lamp 22 and its multiple patch locations and control, FIG. 3 shows a front view of the amalgam fluorescent lamp and attached heater sleeve 46. In a preferred embodiment, lamp 22 is a 24.5 inch long Tri Phosphor, Extra High Output (EHO) amalgam fluorescent lamp operating at a loading of up to 120 watts. The amalgam patches 40, 42, 44 are formed by mercury combining with an indium patch within the lamp envelope. The optimum mercury pressure is achieved with the amalgam at approximately 88° to 100° C. Heater sleeves segments 46A, 46B, 46C, 46D are mechanically secured to the lamp envelope, each functioning to transfer heat to particular portions of the lamp. The lamp heater sleeves, in a preferred embodiment, are constructed of etched foil heating elements and a laminate of nomex and high temperature epoxy resin. Patch elements 40, 44 are positioned internally at opposite ends of the lamp at sufficient distance away from the internal filament so as not to be influenced by the heat produced by the filaments. The patch heater segments 46A–46C are designed, for this embodiment, to operate from a 12 vdc power supply at a nominal loading of 3.75 watts/insq. These elements control the temperature of the amalgam patches 40, 42, 44 respectively. Heater sleeve patch thermistors 40T, 42T, 44T are permanently mounted in contact with the respective patch elements. Fourth sleeve element 46D is used to control the temperature of the surface area that is not adjacent sleeve elements 46A–46C. Thermistor 46T monitors the temperature of the sleeve heater area. These four thermistors, as will be described below, provide information to the heater sleeve controller 50.

Referring to FIGS. 2 and 3, it is seen that there are two main control circuits monitoring and adjusting the lamp. Power supply 54, in conjunction with input from photodetector 56 maintains the lamp at proper illumination levels. Heater sleeve controller 50 maintains the sleeve and patch temperatures at optimum temperature levels based on inputs from their respective thermistors. Controller 50 and power supply 52 are under the overall control of machine controller 52.

Turning first to operation of the illumination power supply circuit 54, the circuit is connected to a 115 vac power source. The circuit contains a circuit which compares the analog reference signal received from controller 56 with the analog illumination intensity signal generated by photodetector 54 during lamp operation. The reference signal represents the desired illumination output level of the lamp during normal operation. Due to factors such photoreceptor changes, machine "dirt" and magnification changes in the optical system, the illumination level may change from the established reference. The input power to the lamp will, in this case be adjusted until the desired illumination output level is reestablished.

Lamp heater sleeve controller circuit 50 has the function of controlling heater power to the lamp heater sleeve segments 46A–46D so as to maintain the amalgam patches 40, 42, 44 at an optimum temperature which will provide minimum temperature variations arising from mercury migration during lamp off periods. As an example, assuming an elevated patch temperature is required for the system (200° or greater) a combination of patch temperature of 200° F. and a sleeve temperature of 190° F. provide the lowest % change of illumination uniformity (±1.85%). Thus, the control circuit of FIG. 3 would be configured to a heater sleeve temperature of 190° C. so as to keep the patches at 200° C.

Figure 4:
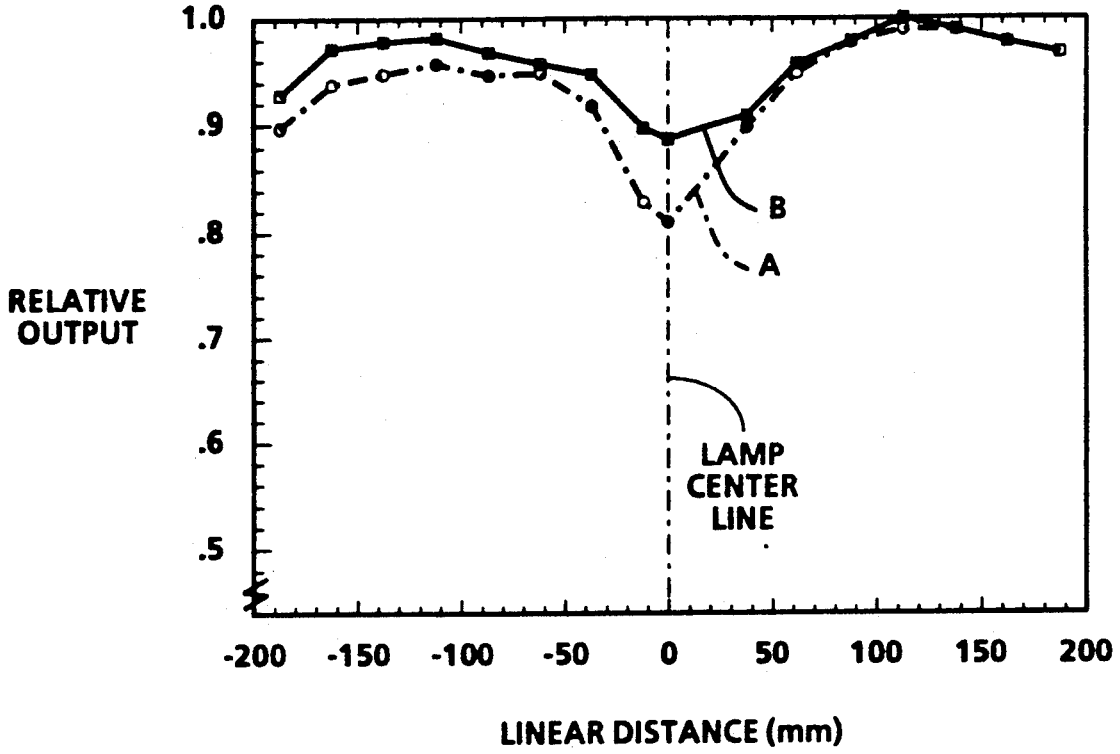
FIG. 4 is a plot of illumination profile output of lamp 22 comparing the output when a single amalgam patch located at two different internal positions.
Figure 5:
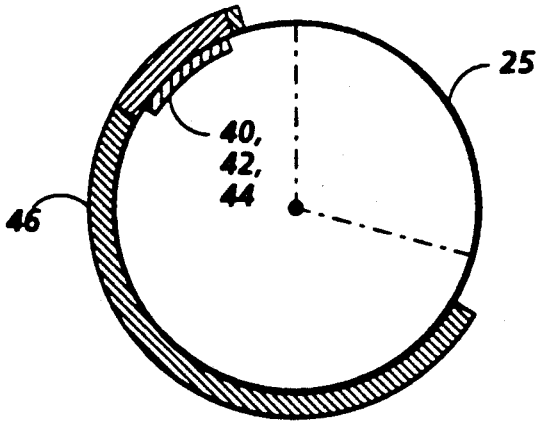
FIG. 5 is an end-view of the amalgam lamp of FIG. 2 showing an alternate location for the amalgam patches.

The above embodiment disclosed the amalgam patch as having a rectangular geometry and as being located, as is conventional with condensed mercury, at a position opposite the aperture. It is a characteristic of the amalgam to be formed as a semi-liquid (paste) that wets the lamp envelope and forms a strong mechanical adhesion of the amalgam to the glass envelope. According to a second aspect of the present invention, it has been found that the patch can be located in lamp locations other than opposite the aperture. This feature is important because the patch, as in the prior art mercury cold spot, when located opposite the aperture had a negative effect on the illumination profile of the lamp output at the platen. FIG. 4 shows a plot of the relative illumination profile of a lamp 22 with a single patch in the location shown in FIG. 2 (plot A). However, if the patch is formed so that it is not in direct view of the exposure area; e.g., at the top of the lamp as shown in FIG. 5, then the illumination profile is improved by reducing the center drop-off, as shown in plot B of FIG. 4. Thus, in the multiple patch geometry of the present invention, the patches could be from outside of the direct view of the exposure area.

According to a still further aspect of the invention, the geometry of the amalgam patches could be specifically tailored to achieve a desired illumination profile at the platen. For this example, the pathes would be formed opposite aperture 25, and within the viewing angle, but instead of the rectangular shape shown in FIG. 3, the patches could be formed for example as longer, narrow segments at the ends, and wider, shorter segments in the middle to attenuate the light so as to reduce the effects of illumination fall-off at the lamp ends.

As another modification that can be made to the arrangement shown in FIG. 3, for some systems lamp 22 that might be longer than the conventional 24 inch length (large document copiers are known to require lamps up to 36 inches in length) more than 3 patches may be required. Two patches would still be formed at the lamp ends and one patch generally centrally located. Additional pairs of patches can then be formed symmetrically between the center and the end patches, each additional patch having the corresponding powered adjacent heater sleeve element.

While the invention has been described with reference to the structure disclosed, it will be appreciated that numerous changes and modifications are likely to occur to those skilled in the art, and it is intended to cover all changes and modifications which fall within the true spirit and scope of the invention.

What is claimed:

1. A monitoring and control system for an amalgam fluorescent lamp, said lamp having a first and second amalgam patch formed on the interior surface of the lamp envelope and at opposite ends, and at least a third amalgam patch formed, at a generally central location on the interior surface of said lamp envelope, and means for providing independent monitoring and controlling of the temperature at each of said amalgam patches so as to provide overall control of the operating temperature of the lamp.

2. The monitoring and control system of claim 1 wherein said means for providing independent monitoring and control of the amalgam patch temperature includes, in combination, a heater sleeve assembly affixed to the external surface of the lamp envelope, said heater sleeve assembly including independently powered heater sleeve elements adjacent each amalgam patch, means for sensing the temperature at each said amalgam patch, and means for monitoring said sensed amalgam patch temperature and for applying power to said heater sleeve elements to maintain the temperatures at said amalgam patches at predetermined optimum temperatures.

3. The monitoring and control system of claim 2 wherein said heater sleeve assembly further includes a heater sleeve element affixed to the external surface of the lamp not covered by said heater sleeve elements adjacent said amalgam patches, a means for sensing the temperature of the lamp envelope adjacent said lamp external surface and, means for monitoring said sensed lamp envelope temperature and for applying power to said heater sleeve element to maintain the temperature at said lamp envelope surface at a predetermined optimum temperature.

4. The monitoring and control system of claim 1 wherein at least an additional pair of amalgam patches are located between the centrally located amalgam patch and each of said end located patches, each of said additional patches being provided with an independently powered heater sleeve element.

5. An electrographic printing machine having a scanning system for illuminating, through the clear aperture of an elongated lamp, longitudinal sections of incremental width of an original document placed on a document platen during the scanning thereof and means for exposing a photosensitive medium to the scanned light images, the scanning system including:

an elongated amalgam fluorescent lamp having a plurality of amalgam patches affixed to the internal wall of the lamp envelope and a full-rate, half-rate mirror scanning system adapted to move beneath the original document in a scan mode to incrementally illuminate the document and reflect an image into a lens which, in turn, projects the image onto a photosensitive medium, and wherein a first and second amalgam patch is located at opposite ends of the lamp envelope and at least a third amalgam patch is formed ata generally central location, and wherein the patches are located in an area of the lamp envelope which is not within the view angle of said aperture.

6. The printing machine of claim 5, wherein the patches are configured so as to attenuate the light output from said aperture to produce a uniform illumination profile at said platen.

7. The printing machine of claim 5 further including means for providing independent monitoring and control of the temperature of each of said amalgam patches so as to provide overall control of the operating temperature of the lamp.

8. An amalgam fluorescent lamp assembly comprising an elongated amalgam fluorescent lamp having a first and second amalgam patch formed on the interior surface of the lamp envelope at opposite ends of the lamp envelope, and at least a third amalgam patch generally centrally located along the lamp envelope, a heater sleeve assembly affixed to the exterior surface of the lamp, said sleeve assembly having electrically separate sleeve elements overlying said amalgam patches and temperature sensing means associated with each of said sleeve elements.

* * * * *